US010953618B2

(12) United States Patent
Miyatake et al.

(10) Patent No.: US 10,953,618 B2
(45) Date of Patent: Mar. 23, 2021

(54) HEATING ROLL PRESS MACHINE AND HEATING ROLL PRESS METHOD

(71) Applicant: Panasonic Intellectual Property Management Co., Ltd., Osaka (JP)

(72) Inventors: Kazufumi Miyatake, Osaka (JP); Toshifumi Nagino, Osaka (JP); Kazuto Fukuda, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 238 days.

(21) Appl. No.: 16/209,131

(22) Filed: Dec. 4, 2018

(65) Prior Publication Data

US 2019/0184668 A1 Jun. 20, 2019

(30) Foreign Application Priority Data

Dec. 18, 2017 (JP) ..... JP2017-241268

(51) Int. Cl.

| | |
|---|---|
| ***B30B 3/04*** | (2006.01) |
| ***B30B 15/30*** | (2006.01) |
| ***B30B 15/34*** | (2006.01) |
| ***B30B 11/18*** | (2006.01) |

(52) U.S. Cl.

CPC ..... *B30B 15/34* (2013.01); *B30B 3/04* (2013.01); *B30B 11/18* (2013.01); *B30B 15/30* (2013.01); *B30B 15/308* (2013.01)

(58) Field of Classification Search

CPC .. B30B 3/00; B30B 3/04; B30B 15/30; B30B 15/308; B30B 15/34; B30B 11/18; B22F 3/18; B22F 2003/185; B22F 5/006; F16C 13/00; H05B 3/00

USPC ..... 100/94, 327, 329

See application file for complete search history.

(56) References Cited

U.S. PATENT DOCUMENTS

| | | | | |
|---|---|---|---|---|
| 5,132,080 | A * | 7/1992 | Pfeil | B01D 39/2034 419/2 |
| 6,342,115 | B1 * | 1/2002 | Pourmand | B30B 5/06 100/308 |
| 6,689,993 | B2 | 2/2004 | Säynäväjärvi | |
| 8,790,572 | B2 * | 7/2014 | Stone | C22F 1/16 419/43 |
| 2002/0092847 | A1 | 7/2002 | Kiiski et al. | |
| 2004/0016478 | A1 * | 1/2004 | Sharpe | B22F 3/18 148/567 |

(Continued)

FOREIGN PATENT DOCUMENTS

| | | |
|---|---|---|
| JP | 2001-066925 | 3/2001 |
| JP | 2001-092289 | 4/2001 |

(Continued)

*Primary Examiner* — Jimmy T Nguyen

(74) *Attorney, Agent, or Firm* — Wenderoth, Lind & Ponack, L.L.P.

(57) ABSTRACT

A heating roll press machine according to the present disclosure includes a pair of rollers and a preheating unit that preheats a processing object before the processing object is conveyed to the pair of rollers. The preheating unit preheats the processing object so that a temperature distribution differs according to positions in a width direction of the processing object to reduce a temperature difference in the width direction of the processing object after the processing object passes through the pair of rollers each having a temperature difference between a roller central part and roller end parts.

5 Claims, 5 Drawing Sheets

(56) References Cited

U.S. PATENT DOCUMENTS

| | | | | |
|---|---|---|---|---|
| 2004/0226466 | A1* | 11/2004 | Kahl | B65H 7/02<br>101/484 |
| 2014/0099556 | A1 | 4/2014 | Johnson et al. | |

FOREIGN PATENT DOCUMENTS

| | | | |
|---|---|---|---|
| JP | 2005-009053 | | 1/2005 |
| JP | 2009-245788 | | 10/2009 |
| JP | 2014-127310 | | 7/2014 |
| JP | 5785918 | B | 9/2015 |

* cited by examiner

BEFORE PASSING THROUGH ROLL PRESS

AFTER PASSING THROUGH ROLL PRESS

HEATING ROLL PRESS MACHINE AND HEATING ROLL PRESS METHOD

TECHNICAL FIELD

The technical field relates to a roll press machine that heats and pressurizes a processing object to roll the object.

BACKGROUND

As pressurization mechanisms that perform pressurization treatment to processing objects such as film, paper, nonwoven fabric, metal foil and steel sheet, a batch-type pressurization mechanism and a continuous-type pressurization mechanism are widely known.

The batch-type pressurization mechanism adopts a method of performing pressurization treatment to the processing object by hydraulic/pneumatic mechanisms or the like in a state where the processing object is sandwiched between a pair of pressing plates. In this case, a process of sandwiching the processing object between the pressing plates, a process of performing pressurization treatment and a process of taking out the pressurized processing object are necessary, therefore, productivity is low.

On the other hand, a roller-type pressurization treatment widely known as the continuous-type pressurization mechanism is a method in which a pair of rollers are arranged to face each other vertically or horizontally and the processing object is inserted into a gap between the pair of rollers to perform pressurization treatment. In this case, the process of taking out the processing object can be continuously performed after the processing object is inserted into the gap between rollers and pressurization treatment is performed, therefore, there is an advantage that high productivity can be obtained.

However, heat is radiated from end parts of the rollers in the case where pressurization treatment is performed by heating the rollers in the roller-type pressurization mechanism, therefore, a difference in temperature is generated between a central part and end parts of the roller. An example is shown in FIG. 4. Even when a roller 101 is uniformly heated, temperatures 101L and 101R at end parts of the roller tend to be reduced as compared with a temperature 101C at a central part of the roller.

Accordingly, a method in which heating devices are installed at end parts of a roller and the end parts of a roller 201 are heated by heaters 202L and 202R as shown in FIG. 5 to thereby suppress reduction of temperatures 201L and 201R at the roller end parts is proposed in Japanese Patent No. 578918 (Patent Literature 1).

SUMMARY

In Patent Literature 1, even if the temperatures 201L, 202R at end parts of the roller 201 can be the same as a temperature 201C at a central part thereof, a temperature 201LC between the temperature 201C at the central part and the temperature 201L at the end part of the roller 201 and a temperature 202RC between the temperature 201C at the central part and the temperature 201R at the end part of the roller 201 are lower than the temperature 201C at the central part of the roller 201 and the temperatures 201L and 201R at the end parts of the roller 201.

That is, in a case where heating pressurization is performed with respect to a powdery material with a large width or a processing object formed by shaping the powder and in other cases, the temperature of the roller differs according to places through which the processing object passes, as a result, the quality of products obtained after heating pressurization varies in a width direction.

An object of the present disclosure is to provide a heating roll press machine and a heating roll press method capable of producing high-quality formed products by reducing variations in temperature in the width direction at the time of heating and pressurization.

A heating roll press machine according to an embodiment includes a pair of rollers and a preheating unit that preheats a processing object before the processing object is conveyed to the pair of rollers, in which the preheating unit preheats the processing object so that a temperature distribution differs according to positions in a width direction of the processing object to reduce a temperature difference in the width direction of the processing object after the processing object passes through the pair of rollers each having a temperature difference between a roller central part and roller end parts.

A heating roll press method according an embodiment includes the steps of preheating a processing object by a preheating unit and feeding the processing object preheated by the preheating unit between a pair of rollers of a heating roll press including the pair of rollers to perform heating pressurization, in which the processing object is preheated so that a temperature distribution differs according to positions in a width direction of the processing object to reduce a temperature difference in the width direction of the processing object after the processing object passes through the pair of rollers each having a temperature difference between a roller central part and roller end parts.

As the processing object is conveyed to the heating roll press after the processing object is heated by the preheating unit in the above structure, the processing object can be pressed in the heating roll press in the state where the temperature difference in the width direction of the processing object is small, which can suppress variations in quality in the width direction of a formed product obtained after the heating pressurization is performed.

DESCRIPTION OF EMBODIMENTS

Hereinafter, a heating roll press machine according to the present disclosure will be explained based on an embodiment.

Figure 1:
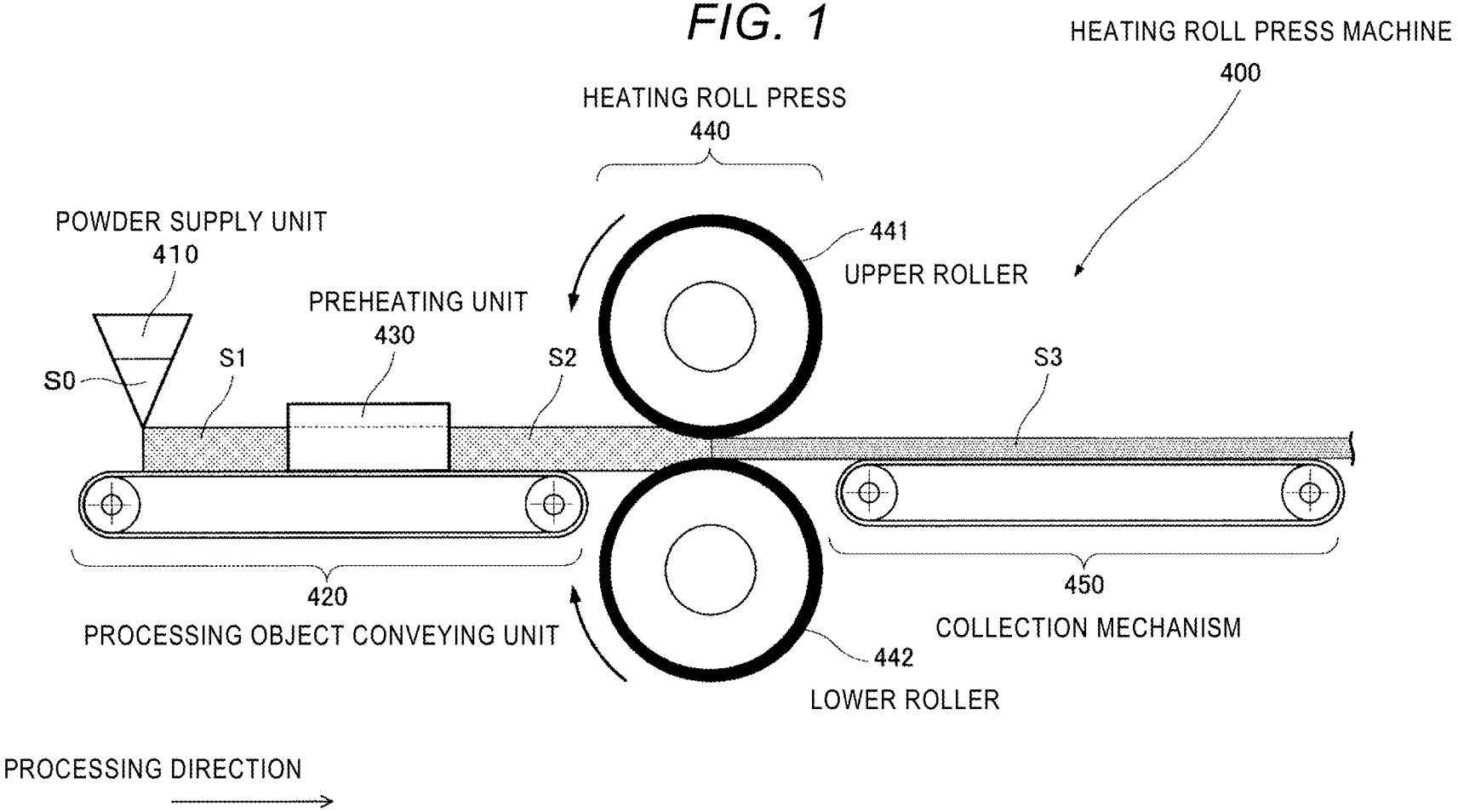
FIG. 1 is a side view of a heating roll press machine according to an embodiment.

FIG. 1 shows the entire line of a heating roll press machine 400 according to the embodiment.

The heating roll press machine 400 includes a heating roll press 440 having a pair of upper roller 441 and a lower roller 442, a processing object conveying unit 420 that conveys a processing object to the heating roll press 440 and a collection mechanism 450 that conveys and collects a formed product S3 obtained by performing heating press and rolling the processing object by the heating roll press 440. The collection mechanism 450 corresponds to, for example, a belt conveyor.

Here, a position of the processing object passing through the heating roll press 440 may be changed in a roller width direction (roller axial direction) of the pair of heating rollers (the upper roller 441 and the lower roller 442) with lapse of time. Accordingly, abrasion of the rollers can be suppressed.

The heating roll press 440 having a mechanism that pressurizes a processing object S2 conveyed from the processing object conveying unit 420 while heating the processing object S2 has heating devices (not shown) for heating the upper roller 441 and the lower roller 442 themselves. The upper roller 441 and the lower roller 442 according to the embodiment face each other with a gap therebetween in an upper and lower direction.

As a method of heating the rollers themselves, either of heating from the inside of the roller and heating from the outside of the roller, or heating from both sides may be adopted. As a device for heating the upper rollers 441 and the lower rollers 442 themselves, heating elements such as a sheath heater, a ceramic heater, a halogen lamp heater, a carbon heater, a flash-lamp heater and an induction heater may be used. The temperature of rollers is controlled by controlling energization with respect to the heating element by a roller heating controller (not shown).

The surface temperature of the upper roller 441 and the lower roller 442 are set to 400° C. or more. This is because temperature variations of the rollers in the roller width direction (an axial direction of the upper roller and the lower roller, the same applies hereinafter) which is the problem to be solved in the disclosure become prominent at 400° C. or more. Generally, a bearing portion near the roller may be deformed or worn out when the temperature is increased, which affects the operation. Therefore, the surface temperature of the upper roller 441 and the lower roller 442 are set to 800° C. or less so that the temperature of the bearing portion does not become too high.

The processing object conveying unit 420 has a function of conveying a processing object S1 supplied from the powder supply unit 410 to the heating roll press 440, which corresponds to, for example, a belt conveyor. As the belt conveyor, a steel belt, a mesh belt and the like may be used.

The powder supply unit 410 has a function of supplying a powder material S0 as an aggregate of particles an average particle diameter of which is several micrometers to approximately 1 centimeter to the processing object conveying unit 420. The powder supply unit 410 corresponds to, for example, a hopper. It is also preferable to perform shaping processing to the powder material S0 for uniformizing the thickness and the width in advance. The shaping processing of the processing object may be performed by pressing the object using a metal mold as well as by compressing the powder material S0 into a sheet shape by using a pair of rollers.

In the middle of the processing object conveying unit 420, a preheating unit 430 that preheats the processing object S1 obtained from the powder material S0 supplied from the powder supply unit 410 is provided. A temperature distribution in the width direction of the processing object in the preheating unit 430 is set so that a temperature difference of the processing object which passes through the heating roll press 440 having a temperature difference between a roller central part and roller end parts in the upper roller 441 and the lower roller 442 of the heating roll press 440 is reduced. That is, the preheating unit 430 that preheats the processing object before the processing object is conveyed to the heating roll press 440 including the upper roller 441 and the lower roller 442 as the pair of rollers is provided, and the temperature distribution in the width direction of the processing object to be preheated in the preheating unit 430 is changed according to positions in the width direction of the processing object so that the temperature difference in the width direction of the processing object which has passed through the pair of rollers each having the temperature difference between the roller central part and the roller end parts is reduced. In other words, the heating roll press 440 includes the upper roller 441 and the lower roller 442 as the pair of rollers and the preheating unit 430 that preheats the processing object which is not fed to the pair of rollers yet. Then, the preheating unit 430 preheats the processing object so that the temperature distribution differs according to positions in the width direction of the processing object to reduce the temperature difference in the width direction of the processing object after the processing object passes through the upper rollers 441 and the lower rollers 442 each having the temperature difference between the roller central part and the roller end parts.

The preheating unit 430 corresponds to, for example, a sheath heater, a ceramic heater, a halogen lamp heater, a carbon heater, a flash-lamp heater and an induction heater. The preheating unit 430 feeds the processing object S2 obtained by preheating the passing processing object S1 to 400° C. or more to the heating roll press 440.

Figure 2:
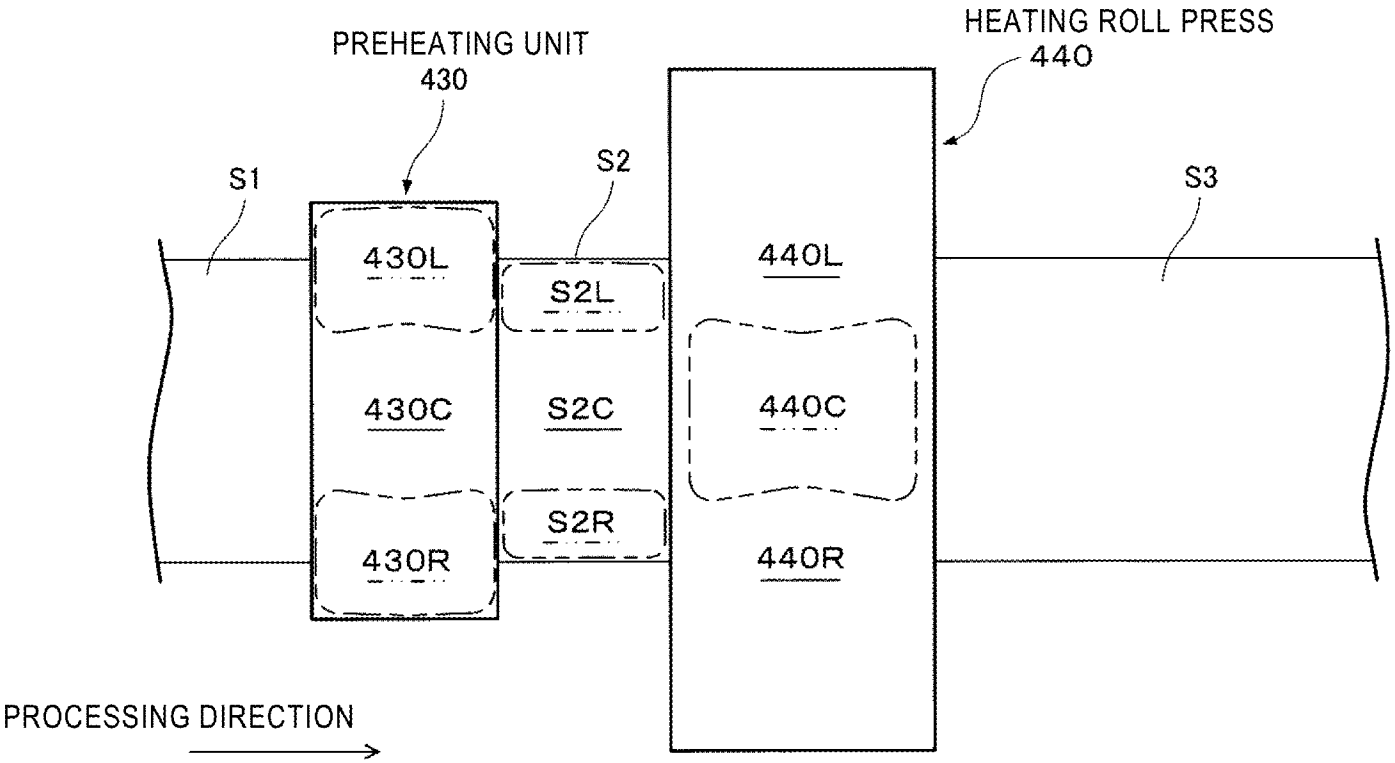
FIG. 2 is a plan view of a main part of the heating roll press machine according to the embodiment.

FIG. 2 is a plan view of the heating roll press machine 400 seen from above.

The upper roller 441 and the lower roller 442 according to the embodiment are arranged with a gap therebetween in the upper and lower direction, and the heated roller radiate heat from end portions as described in the background, therefore, a temperature 440C at the central part of the roller in the roller width direction differs from temperatures 440L and 440R at end parts of the roller in the roller width direction in each of the upper roller 441 and the lower roller 442. That is, the temperature 440C at the roller central part is higher than temperatures 440L and 440R at the roller end parts. Then, heat given to the processing object S2 by the heating roll press 440 is higher in the temperature 440C at the central part in a direction perpendicular to a processing direction than in the temperatures 440L and 440R at the end parts.

Accordingly, when a processing object having a uniform temperature, for example, a room temperature in the entire width direction is allowed to pass through the heating roll press 440 to perform heating pressurization treatment, temperatures at which the object is heated and pressurized differ in the width direction as heat amounts received from the rollers at the time of treatment differ in the width direction of the processing object S2. As a result, quality of the heated and pressurized formed product S3 is not good. For example, in a case of a material in which sintering proceeds at high temperature and at high pressure, a degree of sintering varies in the width direction.

In view of the above, the preheating unit 430 that preheats the processing object S1 during conveyance is provided in the middle of the processing object conveying unit 420 that conveys the processing object to the heating roll press 440, and the processing object S2 obtained by preheating the processing object S1 is conveyed to the heating roll press 440.

Temperatures obtained by the heating of the preheating unit 430 have a distribution in which heating temperatures differ in the width direction of the processing object S1. Specifically, temperatures 430L and 430R at end parts in the width direction of the preheating unit 430 are higher than a temperature 430C at the central part in the width direction of the preheating unit 430. The temperature distribution in the width direction of the processing object in the preheating unit 430 is set so that a higher heat amount is given to the end parts in the width direction of the processing object than to the central part thereof when the surface temperature at the roller central part is higher than the surface temperatures at roller end parts in each of the pair of rollers in the heating roll press 440. In other words, the preheating unit 430 gives the higher heat amount to the end parts in the width direction of the processing object than a heat amount given to the central part in the width direction of the processing object when the surface temperature at the roller central part is higher than the surface temperatures at the roller end parts.

As a result, temperatures in the width direction of the processing object S2 obtained after passing through the preheating unit 430 are not uniform. Specifically, temperatures S2L and S2R at end parts in the width direction of the processing object S2 are higher than a temperature S2C at the central part in the width direction of the processing object S2. The temperatures S2L and S2R at end parts are equivalent to or higher than a heated temperature of the temperature 440C at the central part of the heating roll press 440. Here, the temperature distribution in the width direction of the processing object of the preheating unit 430 is set so that the maximum heating temperature of the pair of rollers of the heating roll press becomes 400° C. or more and 800° C. or less. In other word, the preheating unit controls the temperature distribution in the width direction of the processing object so that the maximum heating temperature of the pair of rollers becomes 400° C. or more and 800° C. or less.

According to the above, relational expressions concerning temperatures of the processing object S2 obtained just before being heated and pressurized by the heating roll press 440 are as follows.

$$440L,\ 440R < 440C \leq S2L,\ S2R$$

$$S2C < 440C \leq S2L,\ S2R$$

A magnitude relation between the temperatures 440L and 440R at end parts of the heating roll press 440 and the temperature S2C at the central part of the processing object S2 does not matter.

Therefore, while the processing object S2 is heated and pressurized by the heating roll press 440, heat at the end parts in the width direction of the processing object S2 is slightly reduced as heat is absorbed by the end parts of the heating roll press 440. On the other hand, the temperature at the central part in the width direction of the processing object S2 is increased by receiving the heat from the central part of the heating roll press 440.

As a result, when the processing object S2 is heated and pressurized by the heating roll press 440, the temperatures at the central part and end parts in the width direction of the processing object S2 are in an approximately uniform state, and the quality in the width direction of the formed product S3 obtained after the heating and pressurization is good. For example, variations in the degree of sintering can be suppressed.

Figure 3A:
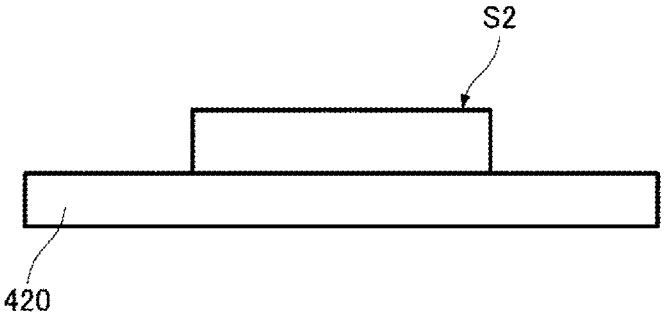
FIGS. 3A and 3B are a cross-sectional view of a processing object obtained before passing through a heating roll press and a cross-sectional view of a formed product obtained after passing through the heating roll press according to the embodiment.
Figure 3B:
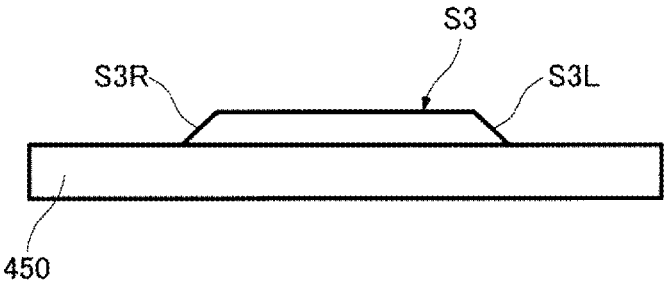
Figure 4:
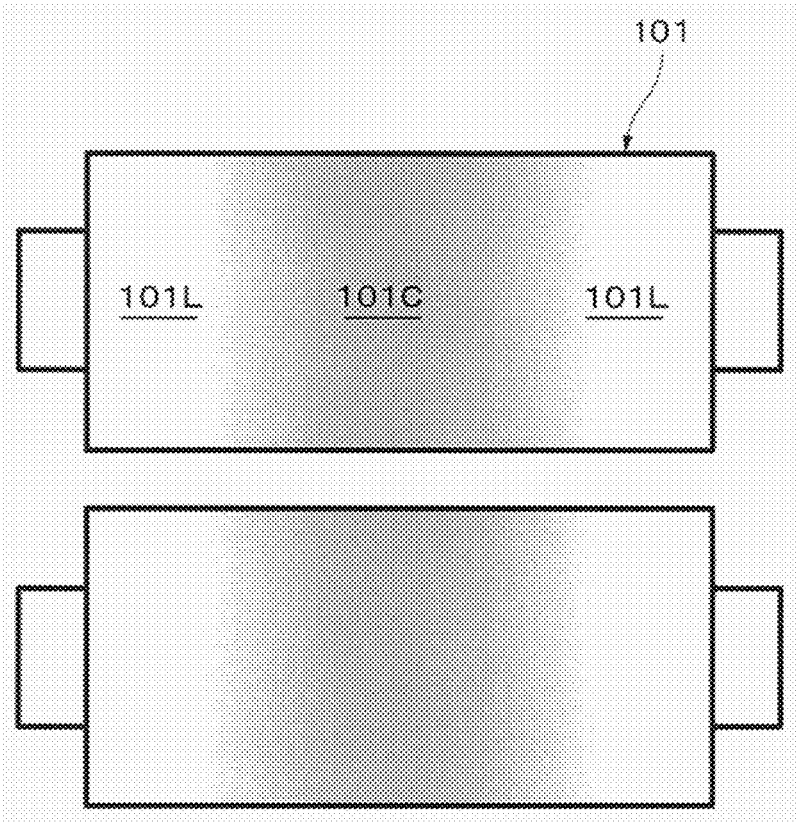
FIG. 4 RELATED ART
FIG. 4 is an explanatory view for problems included in related-art heating rollers.
Figure 5:
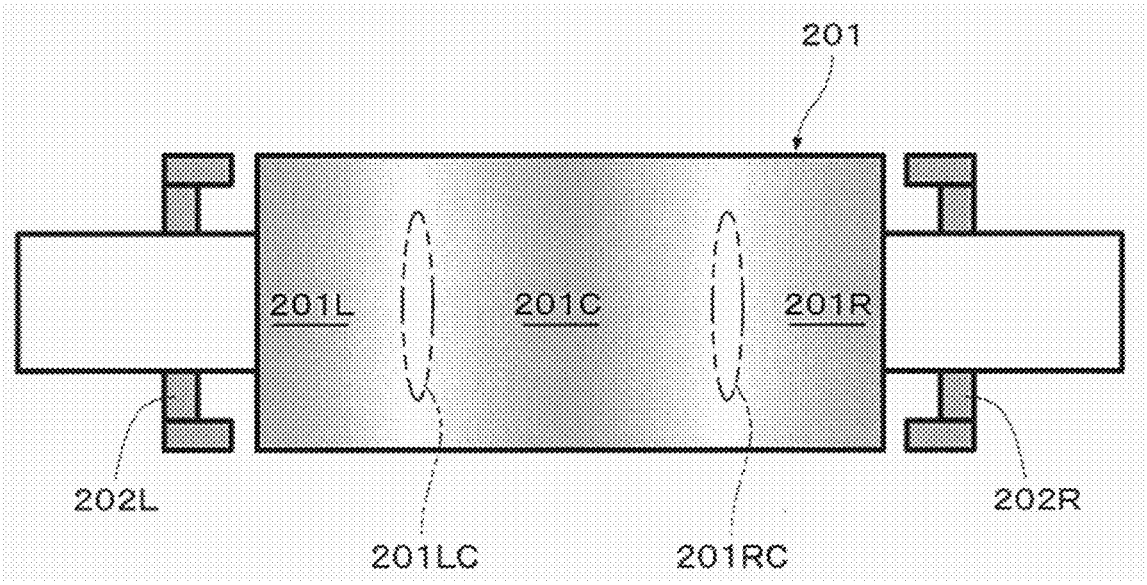
FIG. 5 PRIOR ART
FIG. 5 is an explanatory view for a heating roll press in a prior art example.

A common case where the processing object formed by shaping the powder is pressurized by the heating roll press is shown in FIGS. 3A and 3B. FIG. 3A shows a cross-sectional shape of the processing object S2 obtained before passing through the heating roll press. FIG. 3B shows a cross-sectional shape of the formed product S3 obtained after passing through the heating roll press. As shown in FIG. 3B, end parts S3L and S3R in the width direction of the formed product crumble and the pressure is not applied from the heating roll press 440, which makes a defective product. In contrast to the common example, the preheating unit 430 is provided in the embodiment, therefore, expansion of the formed product S3 in the width direction can be suppressed. Specifically, when the processing object S1 is a material in which hardness is increased by heating such that sintering or reaction proceeds by heating and powders are bound together, expansion in the width direction due to heating and pressurization in the heating roll press 440 can be suppressed as the hardness at end parts in the width direction of the processing object S2 can be increased by preheating the processing object S1 by the preheating unit 430, therefore, improvement in yield and reduction in defective rate can be expected.

In the case where the processing object S1 is the material in which hardness is increased by heating and receives heat and pressurization treatment by the heating roll press 440, surfaces at end parts in the roller width direction of the upper roller 441 and the lower roller 442 may be worn out, therefore, a means for gradually shifting the position of the processing object S2 passing through the heating roll press 440 in the roller width direction of the upper roller 441 and the lower roller 442 with lapse of time is provided, thereby avoiding centralization of abrasions in the rollers and extending the lifetime of the upper roller 441 and the lower rollers 442. For example, a controller (not shown) can manipulate the belt conveyor to shift the position of the processing object S2 in the roller width direction.

Incidentally, when the processing explained above is continuously performed, the temperatures 440R and 440L at end parts of the upper roller 441 and the lower rollers 442 which have received heat from the end parts in the width direction of the processing object S2 may become the same as the temperature 440C at the central part. From the timing when detecting the above state or the timing when detecting that a duration of the continuous operation reaches a first specified time, it is preferable that the temperature control of the preheating unit 430 is automatically switched to 430R=430C=430L for a second specified time, and the operation is performed so that temperatures in the width direction of the processing object S2 become S2R=S2C=S2L. The rollers 441, 442 and the preheating unit 430 can include a temperature sensor for detecting the temperatures.

In the above embodiment, the case where the preheating unit 430 is arranged so that the width direction orthogonal to the processing direction is in the horizontal direction, and the processing object conveying unit 420 is arranged so that the roller width direction of the upper roller 441 and the lower roller 442 is in the horizontal direction to convey the processing object S2 processed by the preheating unit 430 to the heating roll press 440 by the processing object conveying unit 420 has been explained as an example. The present disclosure is not limited to the above structure in which the preheating unit 430 and the roll press 440 are aligned in the horizontal direction along the processing direction, and for example, a case where the processing direction is set to the upper and lower direction (=vertical direction) or an approximately upper and lower direction and the roll press 440 is arranged at a lower position or an approximately lower position of the preheating unit 430 to convey the processing object S2 processed by the preheating unit 430 to the heating roll press 440 can be adopted. In the case where the preheating unit 430 and the processing object conveying unit 420 are arranged in the upper and lower direction along the processing direction as described above, the processing objects S1, S2 and the formed product S3 can be moved by their own weight, therefore, it is not always necessary to provide the processing object conveying unit 420 and the collection mechanism 450.

The roll press machine according to the present disclosure is capable of suppressing variations in quality in the width direction obtained after the heating and pressurization treatment by the rollers by previously heating the material to be heated and pressurized so as to be non-uniform in the width direction.

What is claimed is:

1. A heating roll press machine comprising:

a pair of rollers; and a preheating unit that preheats a processing object before the processing object is conveyed to the pair of rollers, wherein the preheating unit preheats the processing object so that a temperature distribution differs according to positions in a width direction of the processing object to reduce a temperature difference in the width direction of the processing object after the processing object passes through the pair of rollers each having a temperature difference between a roller central part and roller end parts, and wherein the preheating unit controls the temperature distribution in the width direction of the processing object so that a maximum heating temperature of the pair of rollers is 400° C. or more and 800° C. or less.

2. The heating roll press machine according to claim 1, wherein the preheating unit applies a higher heat amount to end parts in the width direction of the processing object than to a central part in the width direction of the processing object when a surface temperature at the roller central part is higher than surface temperatures at the roller end parts in each of the pair of rollers.

3. A heating roll press method comprising:

preheating a processing object by a preheating unit;

feeding the processing object preheated by the preheating unit between a pair of rollers of a heating roll press to perform heating pressurization; and changing a position of the processing object passing through the heating roll press in a roller width direction of the pair of rollers with lapse of time, wherein the processing object is preheated so that a temperature distribution differs according to positions in a width direction of the processing object to reduce a temperature difference in the width direction of the processing object after the processing object passes through the pair of rollers each having a temperature difference between a roller central part and roller end parts.

4. The heating roll press method according to claim 3, wherein the processing object is preheated by giving a higher heat amount to end parts in the width direction of the processing object than to a central part in the width direction of the processing object when a temperature at roller central part is higher than surface temperatures at roller end parts in each of the pair of rollers.

5. A heating roll press machine for performing pressurization treatment to a processing object, the heating roll press machine comprising:

a preheating unit that heats the processing object, the preheating unit applying a first temperature distribution of heat wherein greater heat is applied to end portions of the processing object than to a central portion of the processing object;

a pair of rollers that heat the processing object after having been heated by the preheating unit, the pair of rollers applying a second temperature distribution of heat wherein greater heat is applied to the central portion of the processing object than to the end portions of the processing object; and a belt conveyor transporting the processing object to the preheating unit and the pair of rollers, wherein the preheating unit controls the first temperature distribution in a width direction of the processing object so that a maximum heating temperature of the pair of rollers is 400° C. or more and 800° C. or less.

* * * * *